US006339050B1

(12) United States Patent
Park

(10) Patent No.: US 6,339,050 B1
(45) Date of Patent: Jan. 15, 2002

(54) BRAKE FLUID COMPOSITION FOR AN AUTOMOBILE

(75) Inventor: Ju Chun Park, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/705,758

(22) Filed: Nov. 6, 2000

(30) Foreign Application Priority Data

Dec. 31, 1999 (KR) ..... 99-67779

(51) Int. Cl.[7] ..... C10M 141/02; C10M 141/12
(52) U.S. Cl. ..... 508/198; 508/207
(58) Field of Search ..... 508/198, 207

(56) References Cited

U.S. PATENT DOCUMENTS 3,925,223 A * 12/1975 Coffman et al. ..... 252/78
4,141,851 A * 2/1979 Askew et al. ..... 252/78.3
4,204,972 A * 5/1980 Knoblauch et al. ..... 252/78.1
4,219,434 A * 8/1980 Ellis ..... 252/78.1
4,371,448 A * 2/1983 Knoblauch et al. ..... 252/78.1
5,750,407 A * 5/1998 Becker ..... 437/131

* cited by examiner

*Primary Examiner*—Jacqueline V. Howard
(74) *Attorney, Agent, or Firm*—Birch, Stewart, Kolasch & Birch, LLP

(57) ABSTRACT

The present invention relates to a brake fluid composition comprising a base fluid, a metal corrosion inhibitor, and an antioxidant where said base fluid comprises 70 to 80 wt. % of glycol ether, 18 to 28 wt. % of boric acid ester and 0.8 to 1.2 wt. % of silane-type stabilizer.

4 Claims, No Drawings

BRAKE FLUID COMPOSITION FOR AN AUTOMOBILE

BACKGROUND OF THE INVENTION

1. Field of the Invention

The present invention relates to a brake fluid composition for an automobile and more particularly, to the brake fluid composition comprising a base fluid, a metal corrosion inhibitor, and an antioxidant, where said base fluid comprises 70 to 80 wt. % of glycol ether, 18 to 28 wt. % of a boric acid ester, and 0.8 to 1.2 wt. % of silane -type stabilizer. The brake fluid of the present invention provides high boiling point, excellent corrosion resistance and vaporization, and further provides long periods of use; the wt. % in each case being, relative to the total weight of the fluid.

2. Description of the Prior Arts

Conventional brake fluids are DOT-3 type containing glycol ether, DOT-4 type and DOT-5-1 containing 30–50 wt. % of a boric acid ester and glycol ether. However, said DOT-3 brake fluid has disadvantages, when used long periods such as vapor lock phenomenon with decreased wet boiling point due to absorbing moisture from the air, and insufficient in metal corrosion resistance.

Said DOT-4 and DOT-5-1 brake fluids have better stability than the DOT-3 brake fluid due to high equilibrium reflux boiling point and wet boiling point by using a boric acid ester. However, when DOT-4 and DOT-5-1 brake fluids absorb moisture from the air, boric acid esters are hydrolyzed to boric acids which corrode metal parts as well as they require high manufacturing cost.

Even though DOT-4 and DOT-5-1 brake fluids having long useful life and high stability have been widely used in Europe and Japan, development of brake fluids requiring low manufacturing cost is still required.

SUMMARY OF THE INVENTION

An object of the present invention is to provide a brake fluid composition for an automobile requiring low manufacturing cost, preventing sediment formation of boric acids by hydrolysis of boric acid esters, and improving braking ability of a brake and technical problems and further, providing long periods of use.

DETAILED DESCRIPTION OF THE INVENTION

The present invention relates to a brake fluid composition for an automobile comprising a base fluid, a metal corrosion inhibitor, and an antioxidant, where said base fluid comprising 70 to 80 wt. % of glycol ether, 18 to 28 wt. % of a boric acid ester, and 0.8 to 1.2 wt. % of a silane -type stabilizer; the wt. % in each case being relative to the total weight of the fluid.

The present invention is described in detail hereunder.

The present invention is to provide a brake fluid composition comprising a boric acid ester in a base fluid and a silane ype stabilizer to prevent sediment formation of boric acid from boric acid ester and thus, increases metal corrosion inhibition and provides longer periods for use.

An appropriate ratio of glycol ether and boric acid ester is used to add to a base fluid used in the present invention because a base fluid requires low moisture absorption, high wet boiling point, excellent lubricant so is used in. Examples of said glycol ether include triethylene glycol monomethyl ether, polyalkylene glycol, polyethylene propylene glycol monomethyl ether, and polyethylene glycol monobutyl ether.

Particularly, said triethylene glycol monomethyl ether is used in the range of 20 to 30 wt. %, relative to the total weight of the fluid.

Said polyalkylene glycol is used in the range of 5 to 10 wt. % to the total weight of the fluid to lubricate a cylinder and piston of a brake system. Its average molecular weight is in the range of 700 to 4,000. If the content of polyalkylene glycol is less than 5 wt. %, it does not act enough to lubricate the brake system. On the other hand, if it exceeds 10 wt. %, it is not preferred due to increased viscosity with increased freezing point and expensive manufacturing cost.

Said polyethylene glycol monobutyl ether used for a base fluid is preferred to use in the range of 20 to 30 wt. %, relative to the total weight of the fluid.

Polyethylene propylene glycol monomethyl ether used in a base fluid of the present invention absorbs moisture from the air much less and has higher wet boiling point than other brake compositions. Said polyethylene propylene glycol monomethyl ether is used in the range of 15 to 30 wt. %, relative to the total weight of the fluid.

Especially, boric acid ester is used in the range of 18 to 28 wt. %, relative to the total weight of the fluid. If the content of said boric acid ester is less than 18 wt %, it provides poor physical properties, while the content of said boric acid ester is more than 28 wt. %, it can corrode metals due to sediment formation such as boric acid and causes high manufacturing cost.

A metal corrosion inhibitor in the present invention is used to prevent corrosion and weight change of metal parts and conventionally, a mixture of a phosphate, a triazole and an amine is used. The content of said metal corrosion inhibitor is used in the range of 1.0 to 2.1 wt. %, relative to the total weight of the fluid. The content of said phosphate is 0.5 to 1.0 wt. %, relative to the total weight of metal corrosion inhibitor. If the content of phosphates is less than 0.5 wt. %, it causes corrosion and weight change of zinc, while it exceeds 1.0 wt. %, it causes corrosion and increase in the weight of zinc. Preferable phosphate for metal corrosion inhibitor is triphenyl phosphate. Said triazole and amine in the present invention are used to increase effect and conventionally, 0.2 to 0.5 wt. % of triazole and 0.3 to 0.6 wt. % of amine are used, relative to the total weight of the metal corrosion inhibitor.

An antioxidant in the present invention is used to prevent oxidation of alkyl groups of a base fluid and the content thereof is in the range of 0.3 to 0.6 wt. % relative to the total weight of the fluid. If the content is less than 0.3 wt. %, it is insufficient in preventing of oxidation. While it exceeds 0.6 wt. %, it does not affect an ability of oxidation. Preferred antioxidant in the present invention is dibutylhydroxy toluene.

In particular, a silane-type stabilizer in the present invention is used to prevent corrosion of metals by boric acids produced by hydrolysis of boric acid esters by absorbing moisture from the air. Conventional silane-type stabilizer is used in the present invention and the content thereof is in the range of 0.8 to 1.2 wt. %, relative to the total weight of the fluid. When the content is less than 0.8 wt. %, boric acid is formed. When it exceeds 1.2 wt. %, it is not preferred for corrosion of metal parts. Preferred stabilizer is 3-diethanol aminopropyl silane.

As described above, the brake fluid of the present invention comprising glycol ether and boric acid ester as a base fluid, a metal corrosion inhibitor, an antioxidant and a silane-type stabilizer provides lows manufacturing cost, high wet boiling point and excellent corrosion inhibition and thus provides long periods of use.

The present invention is explained in more detail by the following examples but is not limited by these examples.

EXAMPLES 1–3 AND COMPARATIVE EXAMPLE

Brake fluid compositions of Examples 1–3 and Comparative Example were prepared by conventional method by using each component shown in table 1.

Manufacturing costs of each brake fluid were compared and physical properties were determined by the following methods.

Method

1. Corrosion Test for metals (mg/cm$^2$)

A brake fluid was added to KS M 2142 antifreezing solution test device, the temperature was kept at 100° C., and standard test pieces were kept therein for 240 hours. Oxygen gas was applied with 100 ml/min of rate to activate corrosion.

2. Vaporation Test (%)

Vaporation test was performed according to paragraph 7.8 of KS M 2141 non-oil brake fluid for an automobile.

3. Wet Boiling Point Test (°C.)

Wet boiling point test was performed according to paragraph 7.2 of KS M 2141 non-oil brake fluid for an automobile.

4. Formation of Boric Acid Test

After wet boiling point test, standard test pieces were kept in the desiccator containing 450 ml of water with the temperature of 50° C. for 72 hours. Then, the formation of boric acid was determined by hand touch or naked eyes.

TABLE 1

| Contents (wt. %) | | Example 1 | Example 2 | Example 3 | Comp. Ex. |
|---|---|---|---|---|---|
| Base fluid | Polyethylene glycol monomethyl ether | — | — | — | 20 |
| | Triethylene glycol monomethyl ether | 23 | 20 | 22 | 15 |
| | Polyalkylene glycol | 6.8 | 2 | 7.8 | 8 |
| | Polyethylene monobutyl ether | 21 | 22 | 20 | 20 |
| | Polyethylenepropylene glycol monomethyl ether | 28 | 24 | 22 | — |
| | Boric acid ester | 19 | 23 | 25 | 36 |
| Corrosion inhibitor | Tributyl phosphate | 0.6 | 0.2 | 0.8 | — |
| | Benzotriazole | 0.2 | 0.2 | 0.2 | 0.25 |
| | Tolytriazole | — | — | — | 0.1 |
| | Triethanol amine | 0.3 | 0.4 | 0.5 | — |
| | Cyclohexyl amine | — | — | — | 0.25 |
| | Dibutyl amine | — | — | — | 0.2 |
| Antioxidant | Dibutylhydroxy toluene | 0.3 | 0.45 | 0.55 | — |
| | Bisphenol A | — | — | — | 0.2 |

TABLE 1-continued

| Contents (wt. %) | | Example 1 | Example 2 | Example 3 | Comp. Ex. |
|---|---|---|---|---|---|
| Silane-type stabilizer | 3-diethanol aminopropyl silane | 0.8 | 1.0 | 1.15 | — |

TABLE 2

| Item of test | Standard | | Example 1 | Example 2 | Example 3 | Comp. Ex. |
|---|---|---|---|---|---|---|
| Metal corrosion Test (mg/cm$^2$) | Blik | ±0.2 | 0.02 | 0.01 | 0.01 | 0.13 |
| | Steel | ±0.2 | 0.01 | 0.02 | 0.02 | 0.24 |
| | Aluminum | ±0.1 | 0.03 | 0.02 | 0.02 | 0.28 |
| | Cast iron | ±0.2 | 0.01 | 0.02 | 0.02 | 0.11 |
| | Brass | ±0.4 | 0.04 | 0.06 | 0.07 | 0.24 |
| | Copper | ±0.4 | 0.08 | 0.09 | 0.08 | 0.26 |
| | zinc | ±0.4 | 0.07 | 0.06 | 0.09 | 0.28 |
| Evaporation Test | Below 80% (3 days) | | 53% | 52% | 49% | 57% |
| Wet boiling point Test | Above 155° C. | | 157° C. | 160° C. | 163° C. | 166° C. |
| Formation of boric acid Test | | | N/A | N/A | N/A | formed |

According to the above Examples and Comparative Example, the brake fluid compositions of Examples show superior corrosion inhibition and vaporization and lower wet boiling point than that of comparative example. Further, formation of boric acid is not absorbed in the brake fluid composition of Examples.

The manufacturing costs of brake fluids of Examples are 79 to 84, relative to 100 of the manufacturing cost of the brake fluid of Comparative Example.

The brake fluid composition of the present invention comprising a base fluid comprising glycol ether and boric acid ester, metal corrosion inhibitor, antioxidant, and silane type stabilizer absorbs 20% less moisture than the conventional brake fluid and also provides low wet boiling point, excellent corrosion resistance, evaporation, long useful life, and less manufacturing cost.

What is claimed is:

1. A brake fluid composition for an automobile comprising a base fluid, a metal corrosion inhibitor, and an antioxidant where said base fluid comprises 70 to 80 wt. % of glycol ether, 18 to 28 wt. % of boric acid ester and 0.8 to 1.2 wt. % of a silane stabilizer.

2. The brake fluid composition for an automobile according to claim 1, wherein said glycol ether is a mixture of 20 to 30 wt. % of triethylene glycol monomethyl ether, 5 to 10 wt. % of polyalkylene glycol, 15 to 30 wt % of polyethylene propylene glycol monomethyl ether and 20 to 30 wt. % of polyethylene glycol monobutyl ether.

3. The brake fluid composition for an automobile according to claim 1, wherein said metal corrosion inhibitor is a mixture of 0.5 to 1.0 wt. % of phosphates, 0.2 to 0.5 wt. % of triazoles, and 0.2 to 0.5 wt. % of amines.

4. The brake fluid composition for an automobile according to claim 1, wherein said antioxidant is dibutylhydroxy toluene.

* * * * *